United States Patent [19]

Bender et al.

[11] 4,407,200

[45] Oct. 4, 1983

[54] DETONATOR SUCH AS AN ELECTRICAL MECHANICAL OR FLAME-SENSITIVE DETONATOR

[75] Inventors: Richard Bender, Lauf; Eugen Feuerstake, Eltersdorf, both of Fed. Rep. of Germany

[73] Assignee: Diehl GmbH & Co., Nuremberg, Fed. Rep. of Germany

[21] Appl. No.: 263,308

[22] Filed: May 13, 1981

[30] Foreign Application Priority Data

May 24, 1980 [DE] Fed. Rep. of Germany ..... 3019975

[51] Int. Cl.[3] ..... F42C 19/12

[52] U.S. Cl. ..... 102/202.5; 264/3 C; 149/14; 149/16; 149/27

[58] Field of Search ..... 102/202.5, 202.8, 202.12, 102/202.14, 204, 205, 288; 149/14, 15, 16, 19.3, 27; 264/3 R, 3 C; 86/20 R, 20 A, 20 B

[56] References Cited

U.S. PATENT DOCUMENTS 2,400,103 5/1946 Cobb ..... 102/202.14
2,767,655 10/1956 Seavey ..... 102/275.9
3,186,341 6/1965 Bjorklund et al. ..... 102/202.8
4,088,518 5/1978 Kehren et al. ..... 264/3 C

FOREIGN PATENT DOCUMENTS 2904283 7/1980 Fed. Rep. of Germany ..... 149/19.3

OTHER PUBLICATIONS

*Encyclopedia of Chemical Technology*, 3rd Ed., vol. 9, John Wiley & Sons, New York (1980), pp. 593–598.

*Primary Examiner*—Charles T. Jordan
*Assistant Examiner*—Ted L. Parr
*Attorney, Agent, or Firm*—Scully, Scott, Murphy & Presser

[57] ABSTRACT

Detonators, such as electrical, mechanical and flame-sensitive detonators, and the production thereof, for utilization at low and high temperatures through the use of explosives with high temperature-resistant, thermoplastic materials as binder mediums. The explosive is present as a ruboff-resistant shaped member in cylindrical form or within a cup, while the primary igniting medium in the detonator housing is compressed alone or through the shaped member.

5 Claims, 4 Drawing Figures

DETONATOR SUCH AS AN ELECTRICAL MECHANICAL OR FLAME-SENSITIVE DETONATOR

BACKGROUND OF THE INVENTION

1. Field of the Invention

The present invention relates to a detonator, and to the production thereof through the utilization of a plastic material-bound explosive.

2. Discussion of the Prior Art

A detonator has become known from U.S. Pat. No. 2,767,655 in which the secondary explosive consists of preformed tablets of cyclonite (hexogen). The explosive is wax-bound filled into molds to from tablets, and an initiating explosive material is pressed over the tablets. The initiating explosive is covered with a primer composition. During the compressing of the initiating explosive, such as loose lead azide, possibly there can occur that initiating explosive particles are pressed between the pressing ram and the wall of the detonator housing and will ignite due to the generated friction. Ignited thereby is the entire charge consisting of the initiating explosive and of the secondary explosive. Quite possibly, the somewhat module-like crystals of explosive material dust will, during the compression of the detonator components within the housing, ignite the lead azide, in essence the ignition is effected through adiabatic compressions.

SUMMARY OF THE INVENTION

Accordingly, it is an object of the present invention to provide an economic, safe manufacture for detonators which will also reproduceably operate at storage temperatures of 373° K. and higher.

The foregoing object is solved in that the invention increases the mamufacturing safety through the pretesting of the fimportant detonator components, namely the primary igniting medium and the secondary explosive, in that they are compressed separately from each other. The compressed explosive evidences a completely smooth surface on all sides thereof and a high ruboff resistance so that during testing of the detonator housing there is safely avoided any triggering of the primary igniting medium. Also, in the presence of compressive stresses between the explosive and the primary igniting medium, such as can occur at the flanging or crimping in of the detonator housing, there is avoided an ignition of the detonator.

In a surprising manner, the compressed formed member of explosive, or the explosive which is pressed into a cup, allows that this can be utilized as a pressing ram for the igniting medium within the housing without having to fear the danger of a triggering of the igniting medium.

Moreover, through the present invention there is created the prerequisite for high temperature-resistant igniting chain.

BRIEF DESCRIPTION OF THE DRAWINGS

Reference may now be had to the detailed description of exemplary embodiments of the invention, taken in conjunction with the accompanying drawings; in which.

DETAILED DESCRIPTION

Figure 1:
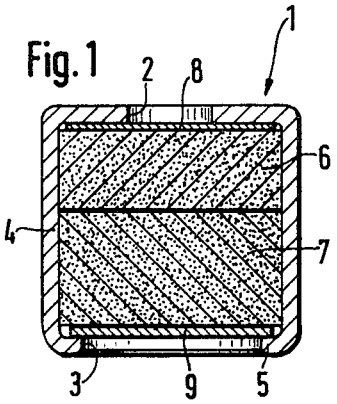
FIG. 1 illustrates a sectional view through a flame-sensitive detonator.

According to FIG. 1, the flame-sensitive detonator 1 consists of a housing 4 constituted of metal, such as aluminum, and is provided with two openings 2, 3. Retained within the housing by means of the flanged in rim 5 are a flame-sensitive compound of lead azide 6, and an explosive which is compressed into a cylinder 7 and which contains 95% octogen (cyclotetramethylenetetranitramine, tetramethylenetetranitramine, also referred to as homocylonite) and 5% copolymerized vinylidenfluoride hexafluropropylene. The openings 2, 3 are closed off through the usual cover disks 8, 9. The lead azide 6 is pressed into the housing 4 through a special manufacturing procedure. In contrast therewith, the explosive material cylinder 7 was already previously prefinished and is now only inserted into the housing 4 which is to be flanged in.

Figure 2:
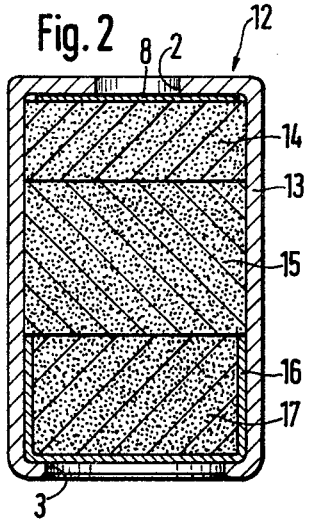
FIG. 2 illustrates a broachable detonator.

Pursuant to FIG. 2, the detonator 12 evidences a broach-sensitive compound 14 within a housing 13, a primary igniting medium 15, for example, lead azide, and a plastic-bound explosive 17 which is pressed into a cup 16 and which consists of 95.75% octagen, 4% styrolacrylate dispersion, and 0.25% zinc stereate.

Figure 3:
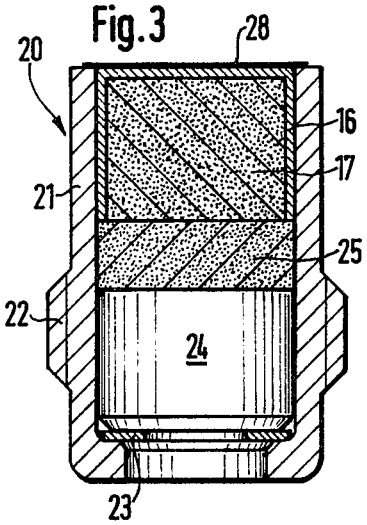
FIG. 3 illustrates an electrically ignitable detonator.

Pursuandt to FIG. 3, the detonator 20 contains a housing 21 with a threaded portion 22, a spacer disk 23, and electrically contactable pole member 24, a primary igniting medium 25, for example lead azide, and an explosive 17 pressed into a cup 16 as is known from FIG. 2. The housing 21 is closed off at the firing side thereof through a usual cartridge lacquer 28.

The explosive 17 pursuant to FIGS. 2 and 3 is pressed into the cup 16 separately from the primary igniting medium. Thereafter, the cup 16 is inserted into the housing 13 or 21 and fastened.

Figure 4:
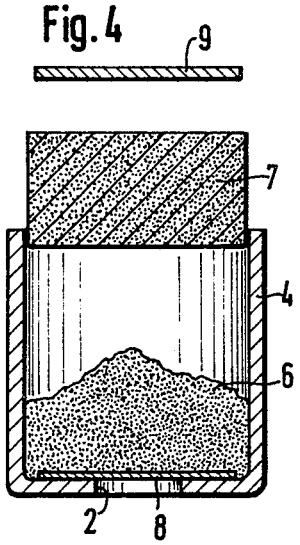
FIG. 4 shows partial process steps in the manufacture of the detonator pursuant to FIG. 1.

According to FIG. 4, the explosive material formed member 7 serves as a press ram for the premeasured lead azide 6 in the housing 4. In lieu of the formed member 7 there can also be utilized the cup 16 with the pressed in explosive 17. While the formed member 7 is inserted into the housing 4, and finally the lead azide 6 is compacted, the resultingly displaced air can escape without difficulty through the gap between the formed member and the housing 4. Air inclusions and adiabatic compression will not occur. Precluded thereby is an ignition of the lead azide 6, and there is afforded an economical manufacture of the detonator. The economic manufacture results, amongst others, from the separately produceable formed member 7, or the completed cup 16, and the safer and more rapid manufacturing steps during the compressing of the loose lead azide 6 in the housing 4. After the pressing of the lead azide 6, there is inserted the closure disk 9 and the housing 4 is flanged in.

The detonators 12 and 20 are also to be finished in a corresponding manner.

In addition to the described explosive material shapes, the explosive can also be pressed into a tube which is open at both ends thereof. Furthermore, in addition to lead azide there are also employable other primary igniting media, for example, mentioned can be silver azide, lead trinitroresorcinate.

During experimentation there have been investigated the described detonators; the detonators prior subjected to temperature changes were ignited at 219° K. and at 403° K. with positive results.

We claim:

1. In a process for the production of electrical, mechanical or flame-sensitive detonators in housings, including a primary igniting medium and secondary explosive wherein the explosive is initially compressed to a shaped member having a compressed density of about 1,7gm/cm$^3$; the improvement comprising: prepressing a plastic-bound explosive selected from the group consisting of octagen, hexogen or hexonite with a high temperature-resistant, thermoplastic material as a binder medium at a temperature of up to about 393° K.; pressing the primary igniting medium into the housing at a usual compressive pressure, said primary igniting medium being selected from the group consisting of loose lead azide, lead trinitroresorcinate or silver azide; said primary igniting medium being pressed with the prefinished explosive material shaped member as a press ram into the housing against the primary charge; and fastening the former through suitable fastening means.

2. A process as claimed in claim 1, comprising fastening said shaped member by flanging in of said housing opening.

3. A process as claimed in claim 1, comprising fastening said shaped member by applying lacquer to said housing opening.

4. A process as claimed in claim 1, wherein said explosive is constituted of 95±0.5% octagen and 5±0.5% copolymerized vinylidenefluoride hexafluoropropylene.

5. A process as claimed in claim 1, wherein said explosive is constituted of 95.75% octagen, 4% styrolacrylate dispersion, and 0.25% zinc stereate.

* * * * *